US008789306B1

(12) United States Patent
Mazzoni

(10) Patent No.: US 8,789,306 B1
(45) Date of Patent: Jul. 29, 2014

(54) PISTOL HOLSTER BRACKET KIT AND METHOD OF MANUFACTURE

(71) Applicant: Paul D. Mazzoni, Blairsville, PA (US)

(72) Inventor: Paul D. Mazzoni, Blairsville, PA (US)

( * ) Notice: Subject to any disclaimer, the term of this patent is extended or adjusted under 35 U.S.C. 154(b) by 0 days.

(21) Appl. No.: 13/869,785

(22) Filed: Apr. 24, 2013

(51) Int. Cl.
*F41C 27/00* (2006.01)
*F41C 33/02* (2006.01)

(52) U.S. Cl.
CPC ..... *F41C 27/00* (2013.01)
USPC ..... 42/90; 42/71.01

(58) Field of Classification Search
CPC ..... Y10S 224/911; Y10S 224/912; Y10S 224/931; F41C 33/041; F41C 33/02; F41C 33/00; F41C 33/008; F41C 23/00; F41C 23/20; F41C 27/00; A45F 2200/0591
USPC ..... 42/71.01, 72, 73, 90, 85, 106; 224/192, 224/193, 191, 197, 198, 243, 911, 912
See application file for complete search history.

(56) References Cited

U.S. PATENT DOCUMENTS

| | | | | |
|---|---|---|---|---|
| 762,862 | A | 6/1904 | Phillips | |
| 1,278,027 | A | 9/1918 | Saunders | |
| 1,554,556 | A | 9/1925 | Camus | |
| 1,557,865 | A | 10/1925 | Neel et al. | |
| 2,605,033 | A | 7/1952 | Terry | |
| 2,734,708 | A | 2/1956 | Cohn | |
| 3,796,358 | A | 3/1974 | Grubb | |
| D248,866 | S | 8/1978 | Gonzales | |
| 5,111,545 | A * | 5/1992 | Krozal | 5/503.1 |
| 5,121,564 | A | 6/1992 | Story | |
| 5,265,365 | A | 11/1993 | Finn | |
| 5,275,317 | A | 1/1994 | Rogers et al. | |
| 5,544,794 | A | 8/1996 | Nichols | |
| 5,771,622 | A * | 6/1998 | Koziuk et al. | 42/74 |
| 6,250,009 | B1 | 6/2001 | Leontuk | |
| 6,374,719 | B1 * | 4/2002 | Phillips | 89/34 |
| 6,467,660 | B1 * | 10/2002 | Rogers et al. | 224/243 |
| 6,755,331 | B2 * | 6/2004 | Rassias | 224/243 |
| 6,769,581 | B2 | 8/2004 | Rogers et al. | |
| 6,874,618 | B1 * | 4/2005 | Cragg | 206/3 |
| 7,540,107 | B2 | 6/2009 | Oum | |
| 7,640,688 | B2 | 1/2010 | Oz | |
| 7,805,873 | B2 | 10/2010 | Bentley | |
| 7,819,294 | B2 | 10/2010 | Lowe et al. | |
| D651,792 | S | 1/2012 | Holiwell | |
| 8,141,758 | B2 | 3/2012 | Spielberger | |
| 8,235,263 | B1 * | 8/2012 | Yeates et al. | 224/243 |
| 8,281,512 | B2 | 10/2012 | Lara | |
| 8,341,867 | B2 * | 1/2013 | Criswell | 42/73 |

(Continued)

OTHER PUBLICATIONS

DPMS Inc. 2012 Catalog pp. 51, 54 and 59. Undated but obtained from the Internet on Apr. 17, 2013.

*Primary Examiner* — Daniel J Troy
*Assistant Examiner* — Joshua Freeman
(74) *Attorney, Agent, or Firm* — Intellalegal; James E. Pravel

(57) ABSTRACT

A bracket kit for attaching a pistol holster to the buttstock of a gun. Kit is universally adaptable to be used by Magpul style buttstocks, DPMS style buttstocks and conventional rifle and shotgun style buttstocks. Kit includes a base plate having a convex and a concave surface, at least one alignment plate to engage with a lower edge of the buttstock and a plurality of straps to secure the base plate to the convex surface of the buttstock. Pistol holster is attached to the convex side of the base plate. Base plate can be attached to either side of the buttstock.

16 Claims, 7 Drawing Sheets

(56) References Cited

U.S. PATENT DOCUMENTS

| | | | | |
|---|---|---|---|---|
| 8,371,056 | B1 | 2/2013 | Baker et al. | |
| 8,651,009 | B2 * | 2/2014 | Hayden et al. | 89/41.02 |
| 2001/0032914 | A1 | 10/2001 | Hawes | |
| 2002/0100780 | A1 * | 8/2002 | Rogers et al. | 224/243 |
| 2005/0178808 | A1 | 8/2005 | Buis et al. | |
| 2006/0144882 | A1 * | 7/2006 | Clifton, Jr. | 224/222 |
| 2008/0000131 | A1 * | 1/2008 | Oum | 42/71.01 |
| 2011/0121043 | A1 * | 5/2011 | Kincaid et al. | 224/191 |
| 2011/0225865 | A1 | 9/2011 | Williams | |
| 2012/0055059 | A1 * | 3/2012 | Cauhape | 42/71.01 |
| 2012/0124882 | A1 * | 5/2012 | Lara | 42/90 |

* cited by examiner

PISTOL HOLSTER BRACKET KIT AND METHOD OF MANUFACTURE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates to the field of holsters for handguns.

BACKGROUND

Long guns are in widespread use throughout the world. A long gun is generally any firearm that is larger than a handgun and is designed to be held with both hands, either from the hip or from the shoulder. Depending on the use and jurisdictional restrictions, long guns typically have a barrel length of between 10 and 30 inches. Long guns are generally defined to include rifles and shotguns. Rifles include, among others, assault type semi-automatic and automatic guns. Assault rifles include different buttstocks including Magpul style buttstocks and DPMS style buttstocks.

A Magpul style buttstock is designed as a drop-in replacement buttstock for AR15/M16 carbines. A Magpul style buttstock includes an open interior portion and is typically collapsible.

A DPMS style buttstock is also collapsible, has a closed interior and may be adapted to be installed on many assault rifles.

Conventional rifles and shotguns include the well known wooden or sometimes polymer or graphite buttstocks. The buttstocks on conventional rifles and shotguns normally have a closed interior.

At times it would be desirable to be able to have ready access to a handgun when using a long gun. U.S. Pat. No. 8,371,056 shows a bracket that is attached to the front, receiver portion of a rifle to hold a pistol on the front of the rifle. U.S. Pat. No. 8,281,512 shows a bracket attached to the receiver of a rifle and a pistol holster attached to the bracket.

What is needed is a bracket kit that can be universally fitted to either side of the buttstock of Magpul style buttstocks, DPMS style buttstocks and conventional rifle and shotgun buttstocks. The bracket kit should allow the secure but releasable mounting of a pistol holster to the buttstock of the long gun.

BRIEF SUMMARY OF THE INVENTION

A bracket kit for attaching a pistol holster to a buttstock of a gun is provided wherein the buttstock is selected from the group consisting essentially of Magpul style buttstocks, DPMS style buttstocks, conventional rifle buttstocks and conventional shotgun buttstocks.

The kit comprises a base plate having a convex surface and a concave surface; a plurality of holes are positioned in the base plate corresponding to the position of a plurality of existing holes in the pistol holster. A plurality of fasteners corresponding to some of the plurality of holes in the base plate are provided to connect the pistol holster to the convex surface of the base plate.

The concave surface of the base plate engages with at least a portion of a convex outer surface of the buttstock. At least one horizontal slot is positioned in a forward upper end of the base plate and at least one horizontal slot is positioned in a rearward upper end of the base plate. At least one alignment plate is rotatably adjustable and removeably attachable to the concave surface and on a rearward lower end of the base plate.

A removable second alignment plate is provided which can be removably attached to the convex surface of the base plate. The second alignment plate is oriented horizontally relative to an upper edge of the base plate. A removable resilient pad is mountable in the same position as the second alignment plate when the second alignment plate is removed.

A first forward strap is threaded through the at least one forward horizontal slot and a first rearward strap is threaded through the at least one rearward horizontal slot. The first forward strap wraps around a forward portion of the buttstock to secure the forward upper end of the base plate to the forward portion of the buttstock and the first rearward strap wraps around a rearward portion of the buttstock to substantially secure the rearward upper end of the base plate to the rearward portion of the buttstock.

The first forward strap and the first rearward strap are approximately the same length. A second forward strap and a second rearward strap are provided that are of approximately the same length and are shorter than the first forward strap and the first rearward strap. At least one short strap is provided that is shorter than the first forward strap and the first rearward strap and is shorter than the second forward strap and the second rearward strap.

A saddle having a concave surface is removeably attachable to an upper surface of said removable rotatable alignment plate.

When the bracket kit is used with a Magpul style stock, the rotatably adjustable and removable alignment plate is attached to the convex surface of the base plate. The second forward strap is used to secure the base plate to the forward portion of the Magpul style stock and the second rearward strap is used to secure the base plate to the rearward portion of the Magpul style stock. The short strap is used to secure the rotatably adjustable and removable alignment plate to a lower portion of the Magpul style stock.

When the bracket kit is used with a DPMS style stock, the second removable horizontal alignment plate is attached to the concave surface of the base plate. The first forward strap is used to secure the base plate to the forward portion of the DPMS style stock and the first rearward strap is used to secure the base plate to the rearward portion of the Magpul style stock.

When the bracket kit is used with a conventional rifle or shotgun style stock, the rotatably adjustable and removable alignment plate is attached to the concave surface of the base plate. The saddle is attached to the upper surface of the removable rotatable alignment plate. The removable resilient pad is secured to the convex surface of the base plate in the same position as the second alignment plate when the second alignment plate is removed. The first forward strap is used to secure the base plate to the forward portion of the conventional rifle or shotgun style stock and the first rearward strap is used to secure the base plate to the rearward portion of the conventional rifle or shotgun style stock.

The base plate and bracket kit can be mounted on either side of the buttstock by changing the orientation of the convex side and concave side of the base plate.

By positioning the holster on the buttstock of the long gun, it is easier and faster to gain access to the pistol than if the pistol holster is mounted on the receiver or on a forward portion of the long gun. This can be particularly true when the inventive kit is used on a collapsible Magpul style or DPMS style buttstock. When a collapsible stock is in the collapsed position, the rifle can be worn suspended in front of the user. When the rifle is in this position having access to the pistol on the buttstock is especially convenient.

DETAILED DESCRIPTION OF THE INVENTION

The following parts list is provided to assist in understanding the invention as shown in the figures and as described herein:

| Part Nbr.: | Description: |
|---|---|
| H | Pistol holster |
| 86a-g | Pistol holster mounting holes |
| B | Base plate |
| B1 | Concave side of base plate |
| B2 | Convex side of base plate |
| 5 | Oval portion of base plate |
| 10 | Upper extended elongated portion of base plate |
| 21 | Slot for angular adjustment plate |
| 25 | Padded strip |
| 22a | Front upper slot |
| 22b | Front lower slot |
| 22c | Rear upper slot |
| 22d | Rear lower slot |

-continued

| Part Nbr.: | Description: |
|---|---|
| 26a, 26b, 26c | Countersunk holes - forward row |
| 27a, 27b, 27c | Countersunk holes - middle row |
| 28a, 28b, 28c | Countersunk holes - rearward row |
| 29a, b | Holes for horizontal alignment plate and resilient pad |
| 90a | Flat head machine screw |
| 90b | Resilient washer |
| 90c | Circular threaded nut |
| 30 | Saddle for conventional rifle or shotgun buttstock |
| 32a, b | Slots for strap in saddle |
| 34 | Concave surface in saddle |
| 40 | Angular alignment plate |
| 42a | Pan head machine screw |
| 42b | Mounting nut |
| 45 | Mounting tab |
| 46 | Mounting hole |
| 47 | Narrow planar surface |
| 47a | Hook and loop fastener for saddle |
| 48 | Wide planar surface |
| 50 | Horizontal alignment plate |
| 52 | Slot |
| 54 | Mounting tab |
| 56 | Wide planar surface |
| 57 | Narrow planar portion of horizontal alignment plate |
| 58a, b | Mounting holes for horizontal alignment plate |
| 102a | Flat head machine screw |
| 102b | Nut |
| 60 | Resilient pad |
| 62 | Threaded layer |
| 70 | Long strap |
| 72 | Medium length strap |
| 74 | Short strap |
| 120 | Opening in lower rib |
| 122 | Lower inner rib |
| 124 | Lower rib |
| 126 | Opening in buttstock |
| 128 | Upper rib |
| 129 | Lower edge of Magpul style buttstock |
| 132 | Slot in DPMS style buttstock |
| 134 | Forward portion of DPMS style buttstock |
| 142 | Lower edge of conventional rifle or shotgun buttstock |

Figure 1:
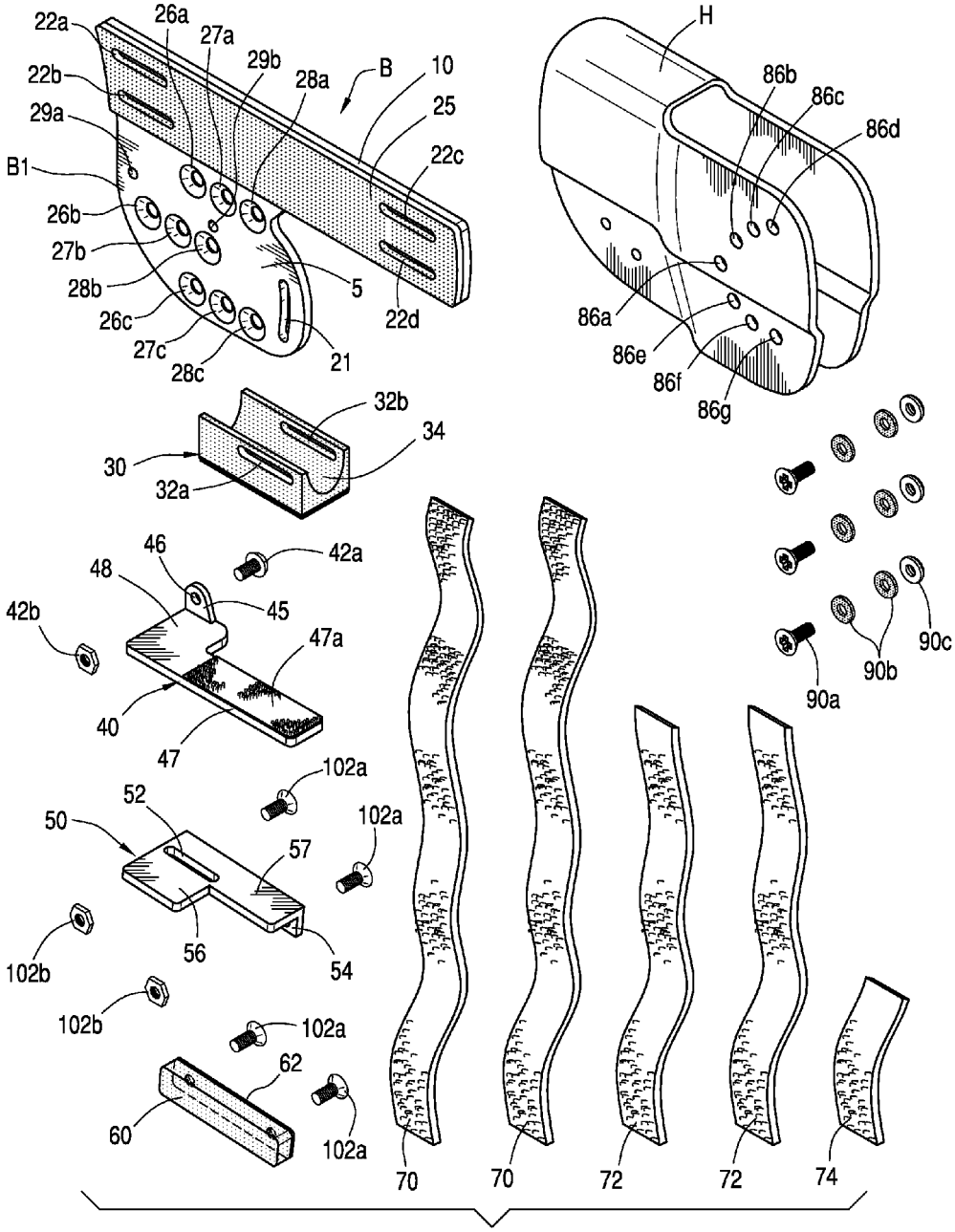
FIG. 1 shows the parts provided as part of the inventive pistol holster bracket kit, together with a typical pistol holster.

In FIG. 1 the inventive bracket kit for attaching a pistol holster H to the buttstock of a gun is shown. The kit is provided to be universally adapted to many different types of gun buttstocks including, but not limited to Magpul style buttstocks M, DPMS style buttstocks D and conventional rifle and shotgun style buttstocks C. The pistol holster H is not included with the kit but is shown to illustrate how the inventive kit is used. The kit is designed to mount any conventional pistol holster H to the base plate B.

The base plate B has a concave side B1 and a convex side B2. The base plate B shown is designed to be attached to the right hand side of the buttstock, but it can also be attached to the left hand side of a buttstock by reversing the orientation of the concave side B1 and convex side B2 of the base plate P. The base plate is shaped with a large oval lower section 5 and an upper extended elongated portion 10. The base plate is typically formed from machined aluminum, but it may also be made from a polymer, graphite, steel, or other desired material. Slots 22*a*, 22*b*, 22*c* and 22*d* are provided on the upper portion 10 of the base plate B. The slots 22*a*, 22*b*, 22*c* and 22*d* are used to secure the base plate to the desired buttstock with straps 70 and 72, as will be discussed below. A padded strip 25 is attached to the upper portion of the base plate B. A plurality of countersunk holes 26*a*, 26*b*, 26*c*, 27*a*, 27*b*, 27*c*, 28*a*, 28*b* and 28*c* are provided in the lower portion of the base plate B. A plurality of flat head machine screws 90*a* are inserted into some of the countersunk holes 26*a*, 26*b*, 26*c*, 27*a*, 27*b*, 27*c*, 28*a*, 28*b* and 28*c* to secure the pistol holster H to the convex side B2 of the base plate B. A rubber washer 90*b* is used on the convex side B2 of the base plate B and a rubber washer 90*b* is used on the inside of the pistol holster H. A round nut 90*c* is used on each of the plurality of flat head machine screws 90*a* to secure the pistol holster H to the base plate B.

Normally, three (3) flat head machine screws 90*a* are used to attach the pistol holster H to the convex side B2 of the base plate B. The position of the holster H can be adjusted forward or rearward by inserting three (3) flat head machine screws 90*a* into 26*a*, 26*b* and 26*c* for a forward mounted pistol holster H; 27*a*, 27*b* and 27*c* for a middle position mounted pistol holster H and 28*a*, 28*b* and 28*c* for a rearward mounted pistol holster H.

The different components shown in FIG. 1 are variously used when adapting the pistol holster bracket to attach to a desired buttstock. After the pistol holster H has been attached to the base plate B, the kit will be configured according to the buttstock on which the pistol holster bracket will attach.

Magpul Style Buttstocks:

For Magpul style buttstocks M, the base plate B is used together with the angular alignment plate 40, two (2) medium length straps 72 and one (1) short strap 74.

DPMS Style Buttstocks:

For DPMS style buttstocks D, the base plate B is used together with horizontal alignment plate 50 and two (2) medium straps 72.

Conventional Rifle or Shotgun Style Buttstocks:

For conventional rifle or shotgun buttstocks C, the base plate B is used together with the horizontal resilient pad 60, the angular alignment plate 40, the saddle 30 and two (2) long straps 70.

Figure 2:
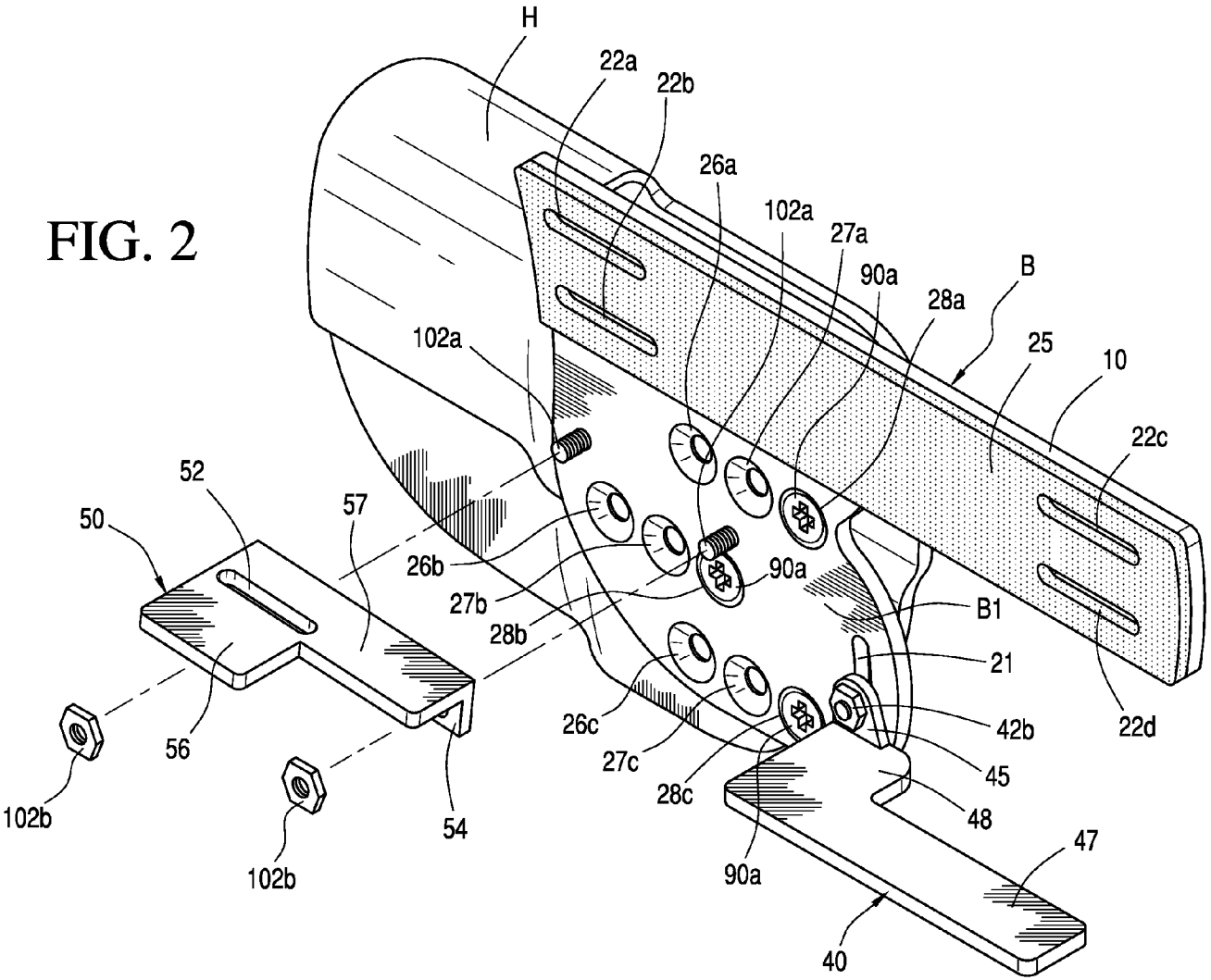
FIG. 2 is an assembly perspective view from the buttstock side showing the base plate, the horizontal plate, the angular adjustment plate, fastener hardware and an attached pistol holster.
Figure 3:
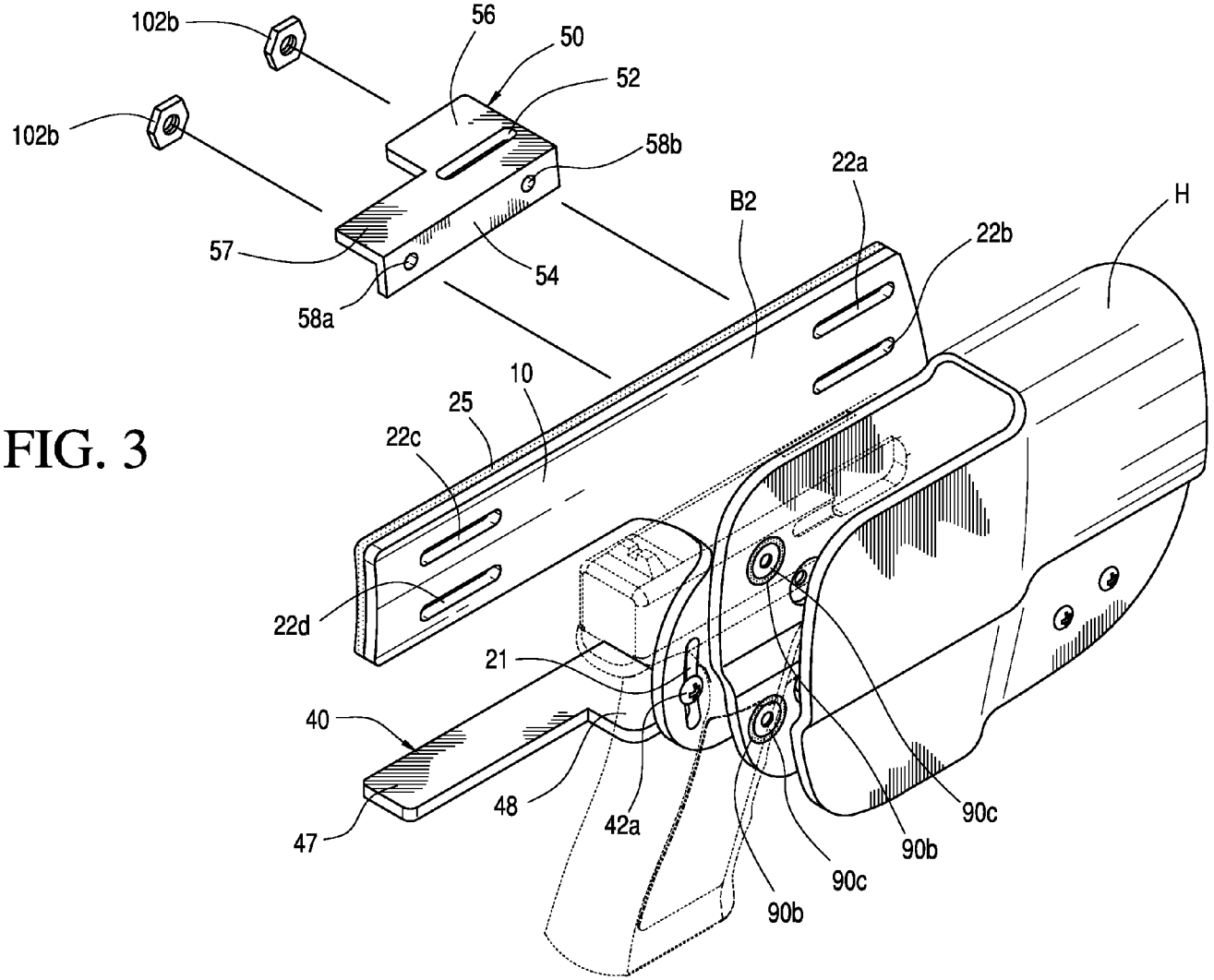
FIG. 3 is an assembly perspective view from the pistol holster side showing the base plate, the horizontal plate, the angular adjustment plate, fastener hardware and an attached pistol holster.

Refer now to FIGS. 2 and 3 in which the pistol holster H is attached to the base plate B. A plurality of flat head machine screws 90*a* are inserted into one or more of the countersunk holes 26*a*, 26*b*, 26*c*, 27*a*, 27*b*, 27*c*, 28*a*, 28*b* or 28*c*. The flat head machine screws 90*a* extend through the concave side B1 of the base plate B, through a resilient washer 90*b*, through a corresponding hole in the pistol holster H, through a second resilient washer 90*b*, then threaded through a circular threaded nut 90*c*.

The horizontal alignment plate 50 is attached to the concave side B1 of the base plate B with flat head machine screws 102*a*, which extend through holes 58*a* and 58*b*. Threaded nuts 102*b* secure the mounting tab 54 of the horizontal alignment plate 50 to the base plate B. The horizontal alignment plate 50 has a wide planar surface 56 and a narrow planar surface 57. A slot 52 extends through the wide planar surface 56 of the horizontal alignment plate 50.

The angular alignment plate 40 is attached to the concave side B1 of the base plate B with a pan head machine screw 42*a* or other fastener. The pan head machine screw extends through the slot 21 into the hole 46 in the tab 45 and secured with a nut 42*b*. Other fastening means may also be used. The angular alignment plate 40 is able to rotate about the mounting hole 46 and move up and down in slot 21. The full range of angular motion and upward and downward motion of the angular mounting plate 40 allows the angular mounting plate 40 to be positioned to fit most any buttstock by positioning the narrow planar surface 47 parallel with and in engagement with the lower edge of the buttstock on which the pistol holster bracket is to be mounted.

The angular alignment plate 40 includes a narrow planar surface 47 and a wide planar surface 48. The mounting tab 45 is connected to the wide planar surface 48.

The padded strip 25 along the upper portion of the concave surface B1 of the base plate B provides resilient, secure and non-slip contact with a portion of the convex surface of the buttstock on which the pistol holster bracket is mounted.

Figure 4A:
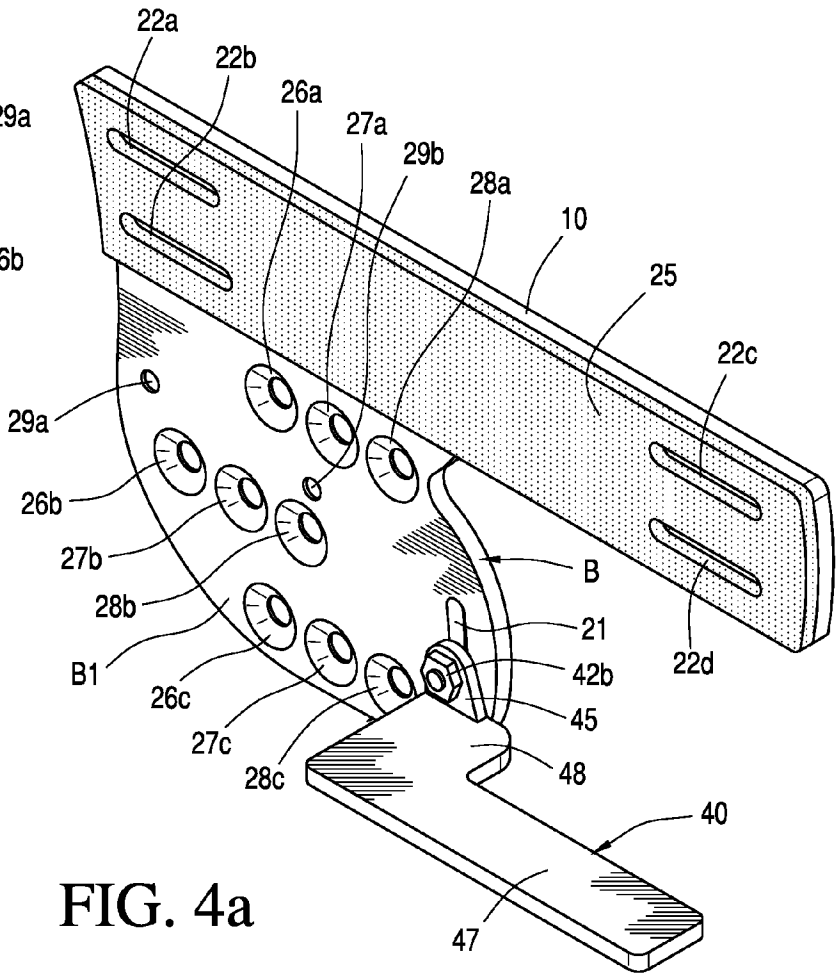
FIG. 4*a* shows a perspective view from the buttstock side of the base plate with the angular adjustment plate attached.
Figure 4B:
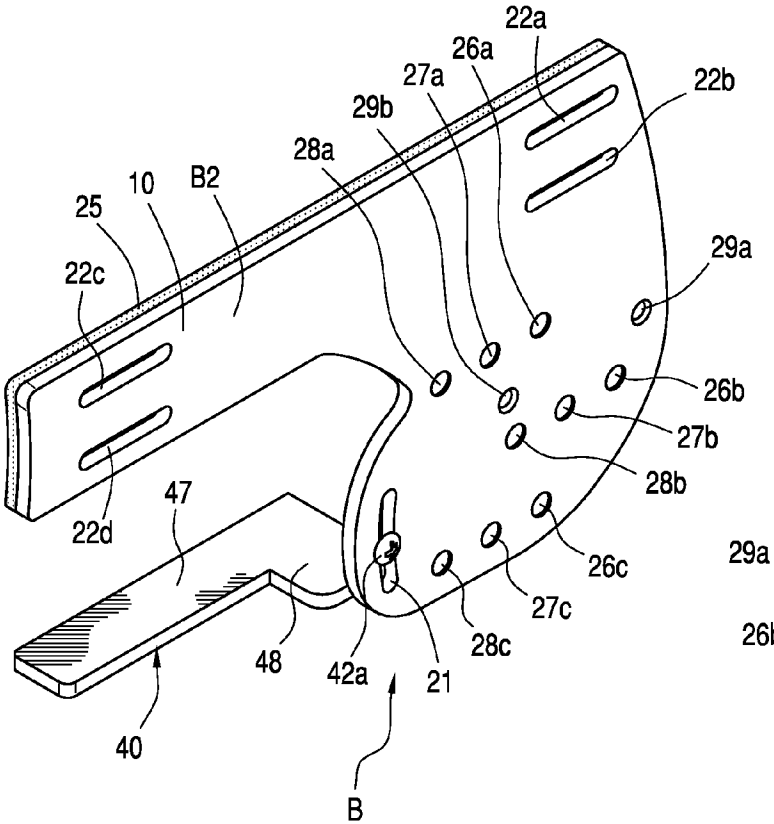
FIG. 4*b* shows a perspective view from the pistol holster side of the base plate with the angular adjustment plate attached.

FIGS. 4*a* and 4*b* show the inventive base plate B and angular alignment plate 40 for clarity without the pistol holster H mounted thereon.

Figure 5A:
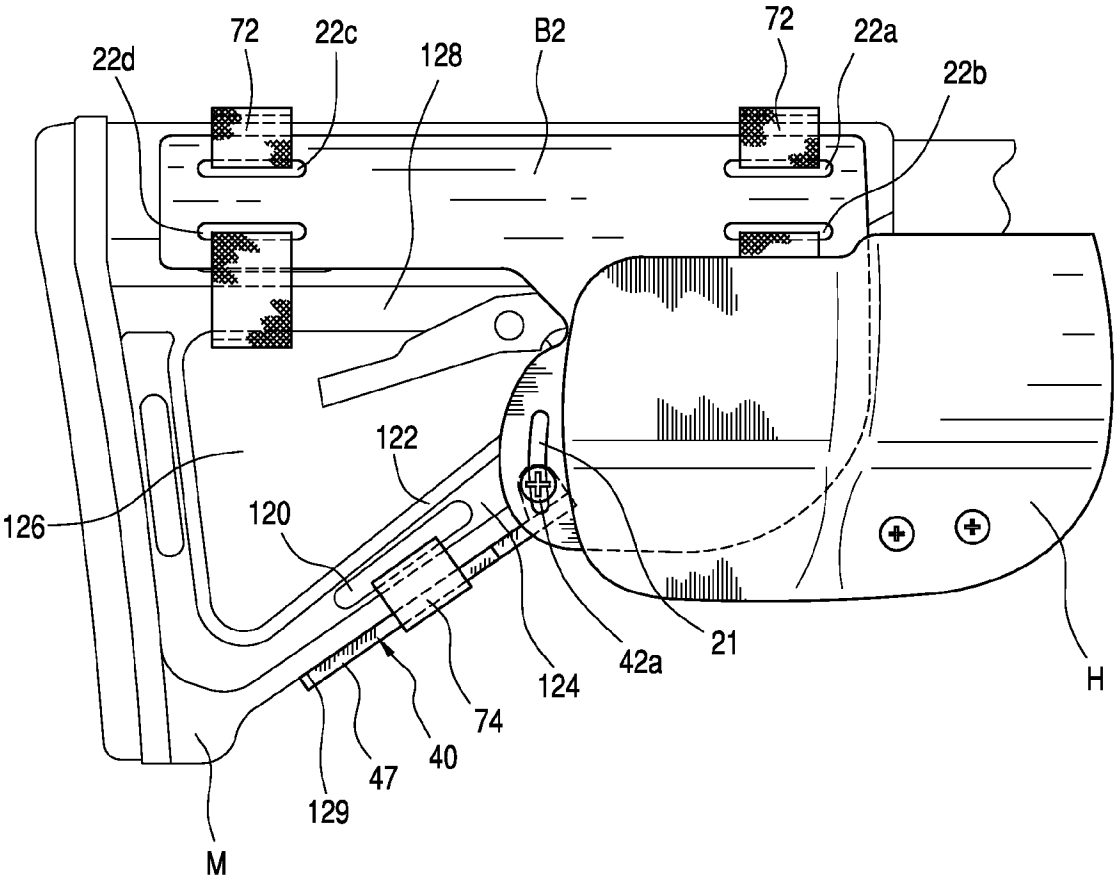
FIG. 5*a* shows the inventive pistol holster bracket kit with a pistol holster attached to a Magpul style buttstock.
Figure 5B:
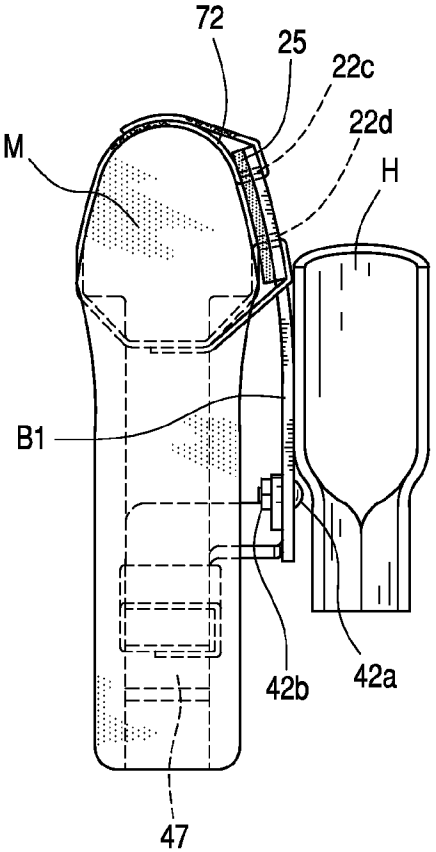
FIG. 5*b* is an end view of the inventive pistol holster bracket kit and holster and Magpul style buttstock shown in FIG. 5*a;*

FIGS. 5*a* and 5*b* show the inventive pistol holster bracket secured to a Magpul style buttstock M. The pistol holster H is secured to the convex side B2 of the base plate B as described above in connection with FIGS. 2 and 3.

The angular alignment plate 40 is secured to the concave side B1 of the base plate B by inserting the pan head machine screw 42*a* through the slot 21. The position of the narrow planar surface 47 is adjusted to engage the lower edge 129 of the Magpul style stock M. A medium length strap 72 is threaded through the upper rearward slot 22*c* on the base plate B, wrapped around the rearward end of the Magpul style stock M and threaded through the lower rearward slot 22*d*. The medium length straps 72 are generally made of hook and loop fastener material such as Velcro. A medium length strap 72 is also threaded through the upper forward slot 22*a* on the base plate B, wrapped around the forward end of the Magpul style stock M and threaded through the lower forward slot 22*b*.

A short strap 74 is wrapped around the lower rib 124 and through the opening 120 in the lower rib 124 to secure the narrow planar surface 47 of the angular alignment plate 40 to the lower edge 129 of the Magpul style buttstock M.

In FIG. 5*b* it can be seen from the end view that as the medium length straps 72 hold the pistol holster bracket securely against the convex upper surface of the Magpul style buttstock M, the padded strip 25 provides a resilient surface for the concave surface B1 of the base plate B to engage with a portion of the convex upper surface of the Magpul style buttstock M. The padded strip 25 prevents scratching of the surface of the Magpul style buttstock M and allows the medium length straps 72 to be fully tightened to provide a resilient engagement between the concave surface B1 of the base plate B and a portion of the convex surface of the Magpul style buttstock M.

Figure 6A:
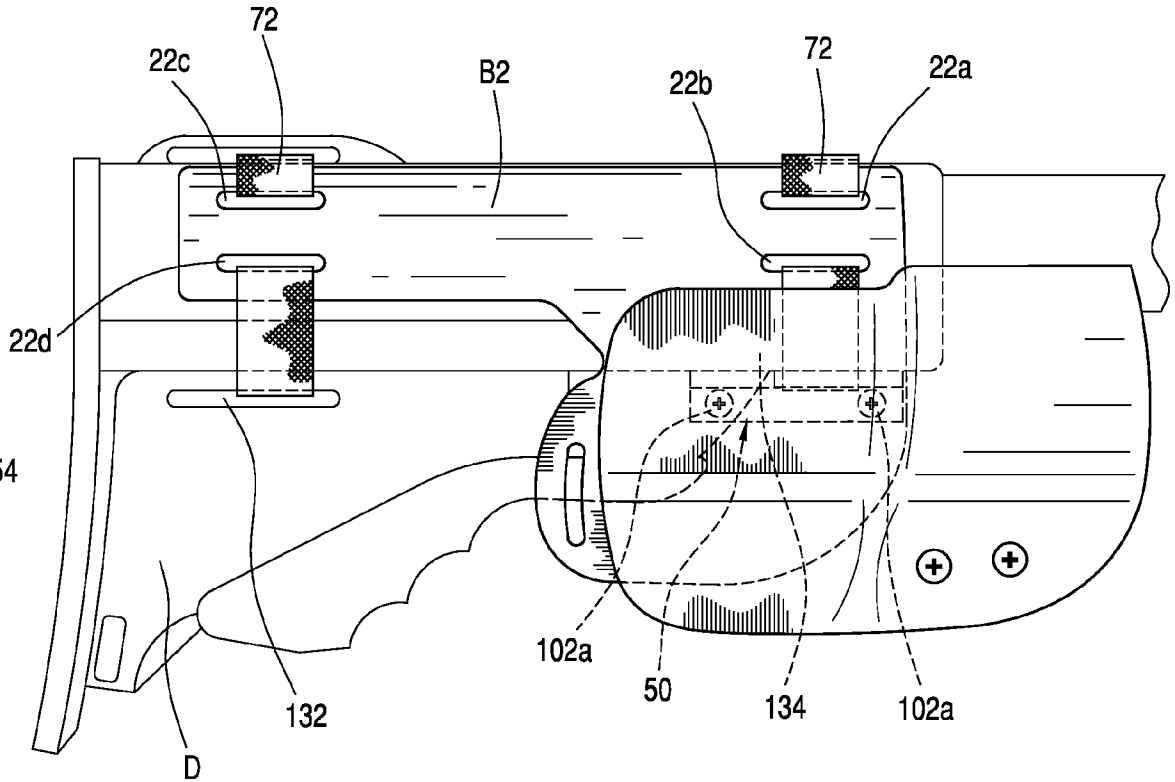
FIG. 6*a* shows the inventive pistol holster bracket kit with a pistol holster attached to a DPMS style buttstock.
Figure 6B:
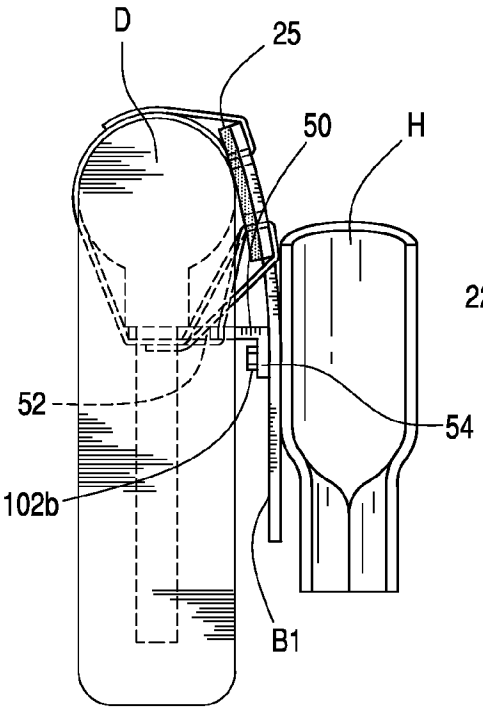
FIG. 6*b* is an end view of the inventive pistol holster bracket kit, holster and DPMS style buttstock shown in FIG. 6*a;*

FIGS. 6*a* and 6*b* show the inventive pistol holster bracket secured to a DPMS style buttstock D. The pistol holster H is secured to the convex side B2 of the base plate B as described above in connection with FIGS. 2 and 3. The horizontal alignment plate 50 is secured to the concave side B1 of the base plate B by inserting the flat head machine screw 102*a* through the holes 29*a* and 29*b* (best seen in FIG. 1). The wide planar surface of the horizontal alignment plate 50 is positioned to engage the lower surface of the forward portion 134 of the DPMS style stock D. A medium length strap 72 is threaded through the upper rearward slot 22*c* on the base plate B, wrapped around the rearward end of the DPMS style stock D, threaded through slot 132 and threaded through the lower rearward slot 22*d* of the base plate B. The medium length straps 72 are generally made of hook and loop fastener material such as Velcro. A medium length strap 72 is also threaded through the upper forward slot 22*a* on the base plate B, wrapped around the forward end of the DPMS style stock D, threaded through the slot 52 (best seen in FIG. 3) and threaded through the lower forward slot 22*b*.

In FIG. 6*b* it can be seen from the end view that as the medium length straps 72 hold the pistol holster bracket securely against the convex upper surface of the DPMS style buttstock D, the padded strip 25 provides a resilient surface for the concave surface B1 of the base plate B to engage with a portion of the convex upper surface of the DPMS style buttstock D. The padded strip 25 prevents scratching of the surface of the DPMS style buttstock D and allows the medium length straps 72 to be fully tightened to provide a resilient engagement between the concave surface B1 of the base plate B and a portion of the convex surface of the DPMS style buttstock D. It can also be seen that by threading the medium length strap 72 through the slot 52 in the wide planar surface of the horizontal alignment plate 50, the entire base plate can be pulled inwardly more securely against the convex surface of the DPMS style buttstock D.

Figure 7A:
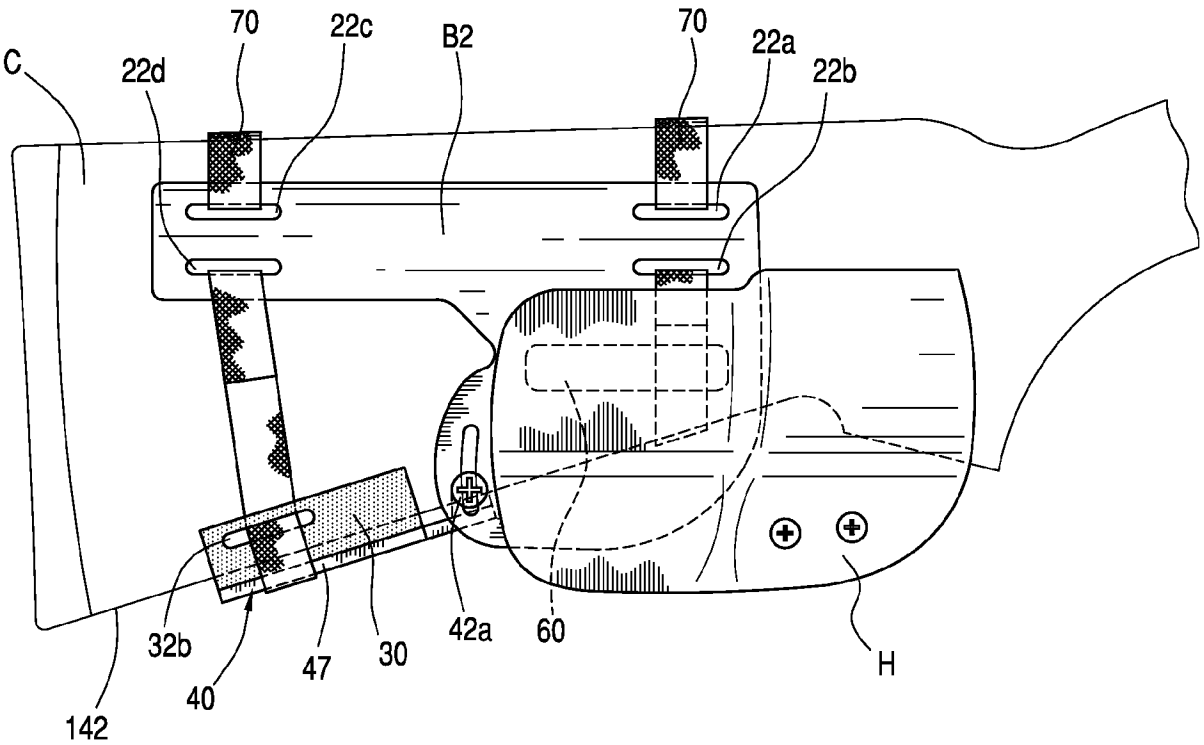
FIG. 7*a* shows the inventive pistol holster bracket kit with a pistol holster attached to a conventional rifle or shotgun buttstock.
Figure 7B:
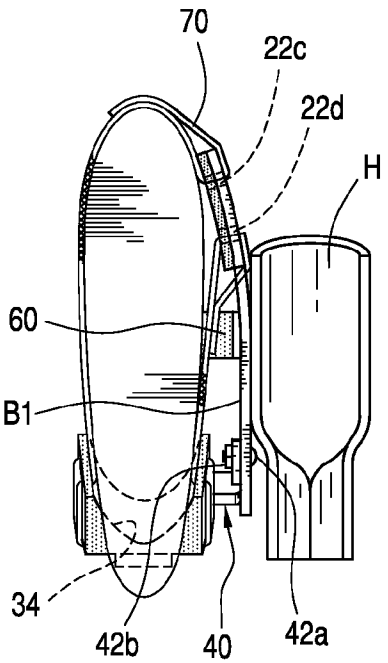
FIG. 7*b* is an end view of the inventive pistol holster bracket kit, holster and conventional rifle or shotgun buttstock shown in FIG. 7*a*.

FIGS. 7*a* and 7*b* show the inventive pistol holster bracket secured to a conventional rifle or shotgun style buttstock C. The pistol holster H is secured to the convex side B2 of the base plate B as described above in connection with FIGS. 2 and 3.

The angular alignment plate 40 is secured to the concave side B1 of the base plate B by inserting the pan head machine screw 42*a* through the slot 21. A saddle 30 is attached to the narrow planar surface 47 with hook and loop 47*a* or other fastener. The position of the narrow planar surface 47 is adjusted so that the concave surface 34 of the saddle 30 engages the lower edge 142 of the conventional rifle or shotgun style stock C. A long strap 70 is threaded through the upper rearward slot 22*c* on the base plate B, wrapped around the rearward end of the conventional rifle or shotgun style stock C, threaded through slots 32*a* and 32*b* (best seen in FIG. 1) and threaded through the lower rearward slot 22*d*. The long straps 70 are generally made of hook and loop fastener material such as Velcro. A long strap 70 is also threaded through the upper forward slot 22*a* on the base plate B, wrapped around the forward end of the conventional rifle or shotgun style stock C and threaded through the lower forward slot 22*b*.

A resilient pad 60 is attached to the concave surface B1 of the base plate B with flat head machine screws 102*a* or other fasteners. The resilient pad 60 includes a threaded layer 62 (best seen in FIG. 1) that includes threaded holes to accept the threaded portion of the flat head machine screws 102*a*. The threaded layer 62 can be constructed of metal, polymer, graphite, or other material in which threads can be formed. The threaded layer 62 is bonded or otherwise attached to the surface of the resilient pad 60.

In FIG. 7*b* it can be seen from the end view that as the medium length straps 72 hold the pistol holster bracket securely against the convex upper surface of the conventional rifle or shotgun style buttstock C, the padded strip 25 provides a resilient surface for the concave surface B1 of the base plate B to engage with a portion of the convex upper surface of the conventional rifle or shotgun style buttstock C. The padded strip 25 prevents scratching of the surface of the conventional rifle or shotgun style buttstock C and together with the resilient pad 60 allows the long straps 72 to be fully tightened to provide a resilient engagement between the concave surface B1 of the base plate B and the convex surface of the conventional rifle or shotgun style buttstock C.

It is contemplated that variations in the individual components and configuration of the components described will fall within the spirit and scope as defined by the claims below. Various types and constructions of straps are contemplated and fasteners to complete the desired construction of the inventive pistol holster bracket kit.

What is claimed is:

1. A bracket kit for attaching a pistol holster to a buttstock of a gun comprising:

a. a base plate having a convex surface and a concave surface;

b. a plurality of holes positioned in said base plate corresponding to the position of a plurality of existing holes in the pistol holster;

c. a plurality of fasteners corresponding to at least some of said plurality of holes in said base plate to connect the pistol holster to said convex surface of said base plate;

d. said concave surface of said base plate engages with at least a portion of a convex outer surface of the buttstock;

e. at least one horizontal slot is positioned in a forward upper end of said base plate and at least one horizontal slot is positioned in a rearward upper end of said base plate;

f. a first forward strap is threaded through said at least one forward horizontal slot and a first rearward strap is threaded through said at least one rearward horizontal slot; said first forward strap wraps around a forward portion of the buttstock to substantially secure said forward upper end of said base plate to said forward portion of the buttstock and said first rearward strap wraps around a rearward portion of the buttstock to substantially secure said rearward upper end of said base plate to the rearward portion of the buttstock; and g. at least one alignment plate is provided to be removably attached to said concave surface of said base plate to engage a lower edge the buttstock to maintain said base plate and the pistol holster in a desired position.

2. A bracket kit for attaching a pistol holster to a buttstock of a gun according to claim 1 wherein the buttstock is a Magpul style buttstock and wherein:

a. said alignment plate is rotatably adjustable and removeably attached to said concave surface and on a rearward lower end of said base plate;

b. said rotatably adjustable alignment plate is attached to a slot having a substantially vertical orientation in said base plate wherein said rotatably adjustable alignment plate can be positioned vertically and rotated angularly to engage the lower edge of the Magpul style buttstock.

3. A bracket kit for attaching a pistol holster to a buttstock of a gun according to claim 2 wherein a strap shorter than said at least one forward strap and shorter than said at least one rearward strap is wrapped around said rotatably adjustable alignment plate to secure said rotatably adjustable alignment plate to a lower portion of the Magpul style stock.

4. A bracket kit for attaching a pistol holster to a buttstock of a gun according to claim 1 wherein the buttstock is a DPMS style buttstock and wherein:

a. said alignment plate is removeably attached to the concave surface of said base plate and is oriented substantially horizontally relative to the DPMS style buttstock;

b. said horizontal alignment plate is positioned to engage a lower edge of the forward portion of the DPMS style buttstock.

5. A bracket kit for attaching a pistol holster to a buttstock of a gun according to claim 4 wherein said horizontal alignment plate is L-shaped in cross-section having an upper planar surface with a wide length and a narrow length; a slot is provided in the wide length through which said first forward strap is threaded to secure said bracket to the forward portion of the DPMS style buttstock.

6. A bracket kit for attaching a pistol holster to a buttstock of a gun according to claim 1 wherein the buttstock is selected from the group consisting essentially of conventional rifle and shotgun buttstocks and wherein:

a. said alignment plate is rotatably adjustable and removeably attached to said concave surface and to a rearward lower end of said base plate;

b. said rotatably adjustable alignment plate is attached to a slot having a substantially vertical orientation in said base plate wherein said rotatably adjustable alignment plate can be positioned vertically and rotated angularly to engage a lower edge of the conventional rifle or shotgun style buttstock; and c. a removable substantially resilient pad is positioned on the concave surface of said base plate below said at least one forward horizontal slot, said resilient pad contacts an outer convex surface of the conventional rifle or shotgun buttstock.

7. A bracket kit for attaching a pistol holster to a buttstock of a gun according to claim 6 wherein a saddle having a concave upper surface is removeably attached to an upper surface of said rotatably adjustable alignment plate whereby the lower edge of the buttstock of the conventional rifle or shotgun is engaged with said concave upper surface of said saddle.

8. A bracket kit for attaching a pistol holster to a buttstock of a gun according to claim 1 wherein a plurality of holes is provided in a horizontal orientation relative to an upper edge of said base plate on a forward end of said base plate to be selectively used to mount a horizontal alignment plate for use on a DPMS style buttstock or to mount a resilient pad to be used on a conventional rifle or shotgun buttstock.

9. A bracket kit for attaching a pistol holster to a buttstock of a gun according to claim 8 wherein said resilient pad includes a threaded layer that is affixed to said resilient pad; said threaded layer is selected from the group consisting essentially of metal, polymer and graphite and wherein said threaded layer includes a plurality of threaded holes that correspond to the plurality of holes provided in a horizontal orientation on the forward end of said base plate whereby when the kit is used with a conventional rifle or shotgun buttstock fasteners are used to attach said resilient pad to said base plate by inserting the fasteners through the plurality of holes provided in a horizontal direction and threading said fasteners to the threaded holes in said threaded layer of said resilient pad.

10. A bracket kit for attaching a pistol holster to a buttstock of a gun according to claim 1 wherein said plurality of holes positioned in said base plate include a series of holes forward and rearward in said base plate to provide various forward and rearward positions of the holster on said base plate.

11. A bracket kit for attaching a pistol holster to a buttstock of a gun according to claim 1 wherein the buttstock is selected from the group consisting essentially of Magpul style buttstocks, DPMS style buttstocks, conventional rifle buttstocks and conventional shotgun buttstocks and wherein:

a. said at least one alignment plate is rotatably adjustable and removeably attachable to said concave surface and on a rearward lower end of said base plate;

b. a removable second alignment plate, said second alignment plate removeably attachable to said concave surface of said base plate oriented horizontally relative to an upper edge of said base plate;

c. a removable resilient pad mountable in the same position as said second alignment plate when said second alignment plate is not mounted on said base plate;

d. said first forward strap and said first rearward strap being of approximately the same length; a second forward strap and a second rearward strap being of approximately the same length and being shorter than said first forward strap and said first rearward strap; at least one short strap being shorter than said first forward strap and said first rearward strap and being shorter than said second forward strap and said second rearward strap;

e. a saddle having a concave surface is removeably attachable to an upper surface of said removable rotatable alignment plate;

f. whereby when the bracket kit is used with a Magpul style stock, said rotatably adjustable and removable alignment plate is attached to a lower rearward end of said convex surface of said base plate, said second forward strap being used to secure said base plate to the forward portion of the Magpul style stock and said second rearward strap being used to secure said base plate to the rearward portion of the Magpul style stock, said short strap being used to secure said rotatably adjustable and removable alignment plate to a lower portion of the Magpul style stock;

g. whereby when the bracket kit is used with a DPMS style stock, said second removable horizontal alignment plate is attached to said concave surface of said base plate, said first forward strap being used to secure the base plate to the forward portion of the DPMS style stock and said first rearward strap being used to secure the base plate to the rearward portion of the Magpul style stock; and h. whereby when the bracket kit is used with a conventional rifle or shotgun style stock, said rotatably adjustable and removable alignment plate is attached to said concave surface of said base plate, said saddle is attached to the upper surface of said removable rotatable alignment plate, said removable resilient pad is secured to said convex surface of said base plate in the same position as said second alignment plate when said second alignment plate is removed, said first forward strap being used to secure said base plate to the forward portion of the conventional rifle or shotgun style stock and said first rearward strap being used to secure said base plate to the rearward portion of the conventional rifle or shotgun style stock.

12. A bracket kit for attaching a pistol holster to a buttstock of a gun according to claim 11 wherein said removable second alignment plate is securable to said concave side of said base plate with a plurality of fasteners, said fasteners extending through a plurality of holes positioned in said base plate and wherein said removable resilient pad is mountable with said plurality of fasteners in said plurality of holes when said removable second alignment plate is removed when said bracket kit is used with a conventional rifle or shotgun buttstock.

13. A bracket kit for attaching a pistol holster to a buttstock of a gun according to claim 12 wherein when said horizontal alignment plate is used with a DPMS style stock, said first rearward strap is threaded through a slot positioned through a horizontally extending planar surface on said horizontal alignment plate.

14. A bracket kit for attaching a pistol holster to a buttstock of a gun according to claim 1 wherein a padded strip is positioned on said concave surface along an upper edge of said base plate whereby scratch damage to the concave surface of the buttstock is prevented and whereby said base plate is provided with both resilient and reliable engagement with the buttstock.

15. A bracket kit for attaching a pistol holster to a buttstock of a gun wherein the buttstock is selected from the group consisting essentially of Magpul style buttstocks, DPMS style buttstocks, conventional rifle buttstocks and conventional shotgun buttstocks and wherein said kit comprises:

a. a base plate having a convex surface and a concave surface;

b. a plurality of holes positioned in said base plate corresponding to the position of a plurality of existing holes in the pistol holster;

c. a plurality of fasteners corresponding to at least some of said plurality of holes in said base plate to connect the pistol holster to said convex surface of said base plate;

d. said concave surface of said base plate engages with a portion of a convex outer surface of the buttstock;

e. at least one horizontal slot is positioned in a forward upper end of said base plate and at least one horizontal slot is positioned in a rearward upper end of said base plate;

f. at least one alignment plate rotatably adjustable and removeably attachable to said concave surface and on a rearward lower end of said base plate;

g. a removable second alignment plate, said second alignment plate removeably attachable to said convex surface of said base plate, said second alignment plate oriented horizontally relative to an upper edge of said base plate;

h. a removable resilient pad mountable in the same position as said second alignment plate when said second alignment plate is not attached to said base plate;

i. a first forward strap is threaded through said at least one forward horizontal slot and a first rearward strap is threaded through said at least one rearward horizontal slot; said first forward strap wraps around a forward portion of the buttstock to secure said forward upper end of said base plate to said forward portion of the buttstock and said first rearward strap wraps around a rearward portion of the buttstock to substantially secure said rearward upper end of said base plate to the rearward portion of the buttstock;

j. said first forward strap and said first rearward strap being of approximately the same length; a second forward strap and a second rearward strap being of approximately the same length and being shorter than said first forward strap and said first rearward strap; at least one short strap being shorter than said first forward strap and said first rearward strap and being shorter than said second forward strap and said second rearward strap;

k. a saddle having a concave surface is removeably attachable to an upper surface of said removable rotatable alignment plate;

l. whereby when the bracket kit is used with a Magpul style stock, said rotatably adjustable and removable alignment plate is attached to the convex surface of said base plate, said second forward strap being used to secure said base plate to the forward portion of the Magpul style stock and said second rearward strap being used to so secure said base plate to the rearward portion of the Magpul style stock, said short strap being used to secure said rotatably adjustable and removable alignment plate to a lower portion of the Magpul style stock;

m. whereby when the bracket kit is used with a DPMS style stock, said second removable horizontal alignment plate is attached to the concave surface of said base plate, said first forward strap being used to secure the base plate to the forward portion of the DPMS style stock and said first rearward strap being used to secure the base plate to the rearward portion of the Magpul style stock; and n. whereby when the bracket kit is used with a conventional rifle or shotgun style stock, said rotatably adjustable and removable alignment plate is attached to the concave surface of said base plate, said saddle is attached to the upper surface of said removable rotatable alignment plate, said removable resilient pad is secured to said convex surface of said base plate in the same position as said second alignment plate when said second alignment plate is removed, said first forward strap being used to secure said base plate to the forward portion of the conventional rifle or shotgun style stock and said first rearward strap being used to secure said base plate to the rearward portion of the conventional rifle or shotgun style stock.

16. A method of assembling a bracket kit for attaching a pistol holster to a buttstock of a gun comprising the steps of:

a. providing a base plate having a convex surface and a concave surface;

b. positioning a plurality of holes in said base plate corresponding to the position of a plurality of existing holes in the pistol holster;

c. including a plurality of fasteners corresponding to at least some of said plurality of holes in said base plate for connecting the pistol holster to said convex surface of said base plate;

d. engaging said concave surface of said base plate with at least a portion of a convex outer surface of said buttstock;

e. positioning at least one horizontal slot in a forward end of said base plate and positioning at least one horizontal slot in a rearward end of said base plate;

f. threading a first forward strap through said at least one forward horizontal slot and threading a first rearward strap through said at least one horizontal rearward slot;

g. wrapping said first forward strap around a forward portion of the buttstock and wrapping said first rearward strap around a rearward portion of the buttstock; and h. providing at least one alignment plate that is removably attachable to said concave surface of said base plate and that when attached, engages a lower edge of the buttstock with said alignment plate to maintain said base plate and the pistol holster in a desired position.

* * * * *

UNITED STATES PATENT AND TRADEMARK OFFICE

CERTIFICATE OF CORRECTION

PATENT NO. : 8,789,306 B1
APPLICATION NO. : 13/869785
DATED : July 29, 2014
INVENTOR(S) : Paul D. Mazzoni It is certified that error appears in the above-identified patent and that said Letters Patent is hereby corrected as shown below:

Title page, item [74] the Attorney, Agent, or Firm should read:

Attorney, Agent, or Firm -- Intellalegal; James W. Pravel

Signed and Sealed this
Tenth Day of February, 2015

Michelle K. Lee

Michelle K. Lee
*Deputy Director of the United States Patent and Trademark Office*